US006686728B2

(12) United States Patent
Nakajima

(10) Patent No.: US 6,686,728 B2
(45) Date of Patent: Feb. 3, 2004

(54) DROPPER-TYPE DC STABILIZED POWER SUPPLY CIRCUIT PROVIDED WITH DIFFERENCE AMPLIFIERS FOR SUPPLYING A STABLE OUTPUT VOLTAGE

(75) Inventor: Akio Nakajima, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/154,838

(22) Filed: May 28, 2002

(65) Prior Publication Data

US 2002/0180409 A1 Dec. 5, 2002

(30) Foreign Application Priority Data

May 29, 2001 (JP) ..... 2001-161055

(51) Int. Cl.[7] ..... G05F 1/56
(52) U.S. Cl. ..... 323/281; 323/274; 323/275
(58) Field of Search ..... 323/273, 274, 323/275, 280, 281

(56) References Cited

U.S. PATENT DOCUMENTS

| | | | | | |
|---|---|---|---|---|---|
| 4,920,309 | A | * | 4/1990 | Szepesi | 323/280 |
| 5,164,657 | A | * | 11/1992 | Gulczynski | 323/275 |
| 5,221,887 | A | * | 6/1993 | Gulczynski | 323/275 |
| 5,347,211 | A | * | 9/1994 | Jakubowski | 323/281 |
| 5,512,814 | A | * | 4/1996 | Allman | 323/280 |
| 5,739,681 | A | * | 4/1998 | Allman | 323/281 |

FOREIGN PATENT DOCUMENTS

| | | | | | |
|---|---|---|---|---|---|
| JP | 59-96604 | U | * | 6/1984 | G05F/1/58 |
| JP | 63-211414 | A | * | 9/1988 | G05F/3/24 |
| JP | 5-289761 | | | 11/1993 | G05F/1/613 |
| JP | 8-500218 | A | * | 1/1996 | H03K/5/08 |
| JP | 09-062380 | A | * | 3/1997 | G05F/1/56 |
| JP | 2000-066745 | A | * | 3/2000 | G05F/1/56 |
| JP | 2000-245148 | | | 9/2000 | H02M/3/28 |
| JP | 2000-284843 | | | 10/2000 | H02M/3/155 |
| JP | 2001-042954 | A | * | 2/2001 | G05F/1/56 |

* cited by examiner

*Primary Examiner*—Jeffrey Sterrett
(74) *Attorney, Agent, or Firm*—Birch, Stewart, Kolasch & Birch, LLP

(57) ABSTRACT

A dropper-type DC stabilized power supply circuit is arranged such that a power transistor is connected in series with a power source line, a first difference amplifier compares (i) a feedback value acquired by dividing an output voltage with (ii) a reference voltage. The first difference amplifier controls the base current of the power transistor with reference to the difference above so as to stabilize the output voltage. This DC stabilized power supply circuit is additionally provided with second and third difference amplifiers having respective offset voltages in inputs thereof. When the output voltage surpasses a predetermined voltage level, the second difference amplifier restrains the base current. On the contrary, when the output voltage falls below a predetermined voltage level, the third difference amplifier increases a bias current of the first difference amplifier so as to increase the gain.

7 Claims, 11 Drawing Sheets

DROPPER-TYPE DC STABILIZED POWER SUPPLY CIRCUIT PROVIDED WITH DIFFERENCE AMPLIFIERS FOR SUPPLYING A STABLE OUTPUT VOLTAGE

FIELD OF THE INVENTION

The present invention relates to a dropper-type DC stabilized power supply circuit in which a power transistor is provided in series with a power supply line connecting a DC power source and a DC load so that an output voltage is stabilized by controlling a base current of the power transistor, and especially pertains to an improvement of the responsiveness of the output voltage when stabilizing the voltage.

BACKGROUND OF THE INVENTION

FIG. 8 is a block diagram illustrating an electric structure of a typical dropper-type DC stabilized power supply circuit 1 of conventional art. This DC stabilized power supply circuit 1 is generally arranged such that an output capacitor c is externally attached to a circuit chip 2 of a semiconductor, and a power transistor q is provided in series with a power source line 3 between an input terminal p1 connected to a DC power source so as to receive an input voltage Vin and an output terminal p2 connected to a DC load so as to output an output voltage Vo. The base current of the power transistor q is controlled by a base drive circuit composed of a control transistor tr, etc.

The output voltage Vo is divided by voltage dividing resistors r1 and r2 so that a divided voltage value Vadj is generated, and the divided voltage value Vadj and an external reference voltage Vref, the latter complying with a band gap voltage, are supplied to a difference amplifier a. The voltages Vadj and Vref are compared with each other by the difference amplifier a, and the difference between the voltages is amplified so as to be sent to the base of the control transistor tr. Also, the control transistor tr controls the base current of the power transistor q and hence the output voltage Vo is kept at a constant value. Between the base and the emitter of the power transistor q, a bias resistor r3 is provided, whereas to the emitter of the control transistor tr, a current restraining resistor r4 is connected. These resistors r3 and r4 constitute the above-identified base drive circuit.

Because of the arrangement above, when, for instance, a load current Io is increased so that the output voltage Vo is lowered below an predetermined output voltage Vc, in other words, when the divided voltage value Vadj is lowered below an external reference voltage Vref, the difference amplifier a and the base drive circuit let a base current Id of the power transistor q flow so as to turn the power transistor q on, so that the output voltage Vo is increased. On the contrary, when a load current Io is decreased so that the output voltage Vo is increased above the predetermined output voltage Vc, the difference amplifier a and the base drive circuit stop a base current Id of the power transistor q so as to turn the power transistor q off, so that the output voltage Vo is decreased. On this account, the output voltage Vo is controlled to be equal with the predetermined output voltage Vc.

The output capacitor c is provided so as to stabilize the output voltage Vo. The impedance of the output capacitor c is represented by $1/j\omega c$. The frequency characteristics of the output capacitor c is, for instance, arranged as illustrated in FIG. 10, and on account of the output capacitor c, the impedance in high-frequency band is reduced.

The DC stabilized power supply circuit 1 as arranged above causes a problem such that when a phase compensation capacity of the difference amplifier a is enlarged to stabilize the output voltage Vo, the response of the feedback system is slowed down and the output voltage Vo greatly varies in accordance with the variation of the load. As illustrated in FIG. 9, for instance, when the load is decreased, i.e. the load current Io is decreased, the power transistor q is not promptly cut off and thus the output voltage Vo becomes much greater than the predetermined output voltage Vc. In this case, the output voltage Vo is out of control until the electrical charge charged in the output capacitor c is discharged at an impedance of the output from the output capacitor c. On the contrary, when the load is increased, i.e. the load current is increased, the output voltage Vo becomes much smaller than the predetermined voltage Vc.

Therefore, especially when the output capacitor c has small capacity and ESR (Equivalent Series Resistance), an overshoot of the output voltage Vo is conspicuous under light load so that the output voltage Vo is unstable, and hence the output voltage Vo oscillates so as to show a triangular waveform as illustrated in FIG. 11. Thus to stabilize the output voltage Vo, the capacity of the output capacity c has to be large.

Moreover, when the gain of the difference amplifier a is increased, the output voltage Vo tends to be oscillated. This tendency is prominent especially when the capacity of the output capacitor c is decreased. In the meantime, when the gain of the difference amplifier a is decreased, the output voltage Vo hardly keeps up with a rapid variation of the load, so that the gain of the difference amplifier a cannot be varied much.

Since devices such as mobile devices have rapidly adopted a surface mounting technology and have become miniaturized, the DC stabilized power supply circuit has also adopted the surface mounting technology and have become miniaturized, and along with this tendency, a surface-mounted/chip-type output capacitor c has frequently been used therein and miniaturization of the capacitor has eagerly been attempted. However, for stabilizing the output voltage Vo, there is still a case that an output capacitor c, which is larger than the circuit chip 2, is adopted as things stand now.

SUMMARY OF THE INVENTION

The present invention aims at providing a DC stabilized power supply circuit which is capable of supplying a stable output voltage with an output capacitor having small capacity.

To achieve the above-identified aim, the DC stabilized power supply circuit in accordance with the present invention includes: a power transistor connected in series with a power supply line; a first difference amplifier in which an output voltage is stabilized by controlling a base current of said power transistor according to a difference between a feedback value of said output voltage and a predetermined first reference voltage so that said feedback value and said first reference voltage are equal to each other; a second difference amplifier in which a second reference voltage greater than said first reference voltage by a predetermined level is set, and the greater said feedback value of the output voltage is than said second reference voltage, the more said base current of the power transistor is restrained; and a third difference amplifier in which a third reference voltage smaller than said first reference voltage by a predetermined level is set, and the smaller said feedback value of the output voltage is than said third reference voltage, the more a gain of said first difference amplifier is increased.

According to this arrangement, the dropper-type DC stabilized power supply circuit is additionally provided with the second and third difference amplifiers which operate in parallel with the first difference amplifier and set reference voltages respectively greater and smaller than the first reference voltage of the first difference amplifier which controls the base current of the power transistor, by a predetermined level. When the output voltage is greater than a value in accordance with the second reference voltage, the second difference amplifier restrains the base current of the power transistor so as to shorten the period during which the power transistor is turned off, and consequently the output voltage promptly decreases. On the contrary, when the output voltage is smaller than a value in accordance with the third reference voltage, the third difference amplifier increases the gain of the first difference amplifier so as to shorten the period during which the power transistor is turned on, and consequently the output voltage promptly increases.

Thus, it is possible to further stabilize the output voltage and reduce the capacity of the output capacitor.

Moreover, the DC stabilized power supply circuit in accordance with the present invention generates, as described above, the second reference voltage of the second difference amplifier and the third reference voltage of the third difference amplifier, using a band gap voltage.

Thus, even if the external reference voltage is commonly applied to the second and third difference amplifiers as well as the first difference amplifier, it is possible to set the second and third reference voltages by simply using input offset voltages generated due to the variation of the emitter areas of the transistors of the differential pairs of the second and third difference amplifiers.

For a fuller understanding of the nature and advantages of the invention, reference should be made to the ensuing detailed description taken in conjunction with the accompanying drawings.

DESCRIPTION OF THE EMBODIMENTS

Referring to FIGS. 1 to 7, an embodiment of the present invention will be described as follows.

Figure 1:
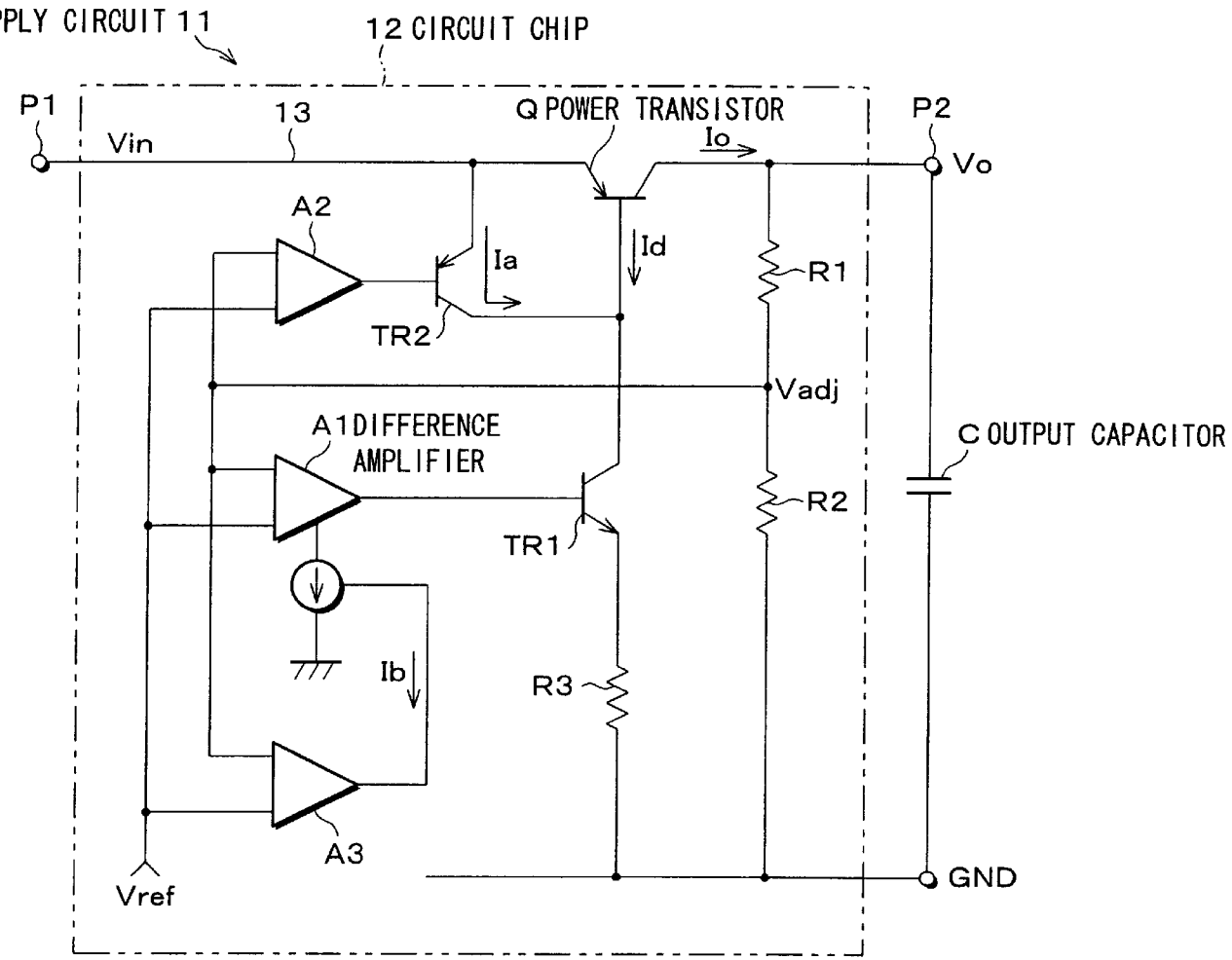
FIG. 1 is a block diagram illustrating an electrical arrangement of a DC stabilized power supply circuit in accordance with an embodiment of the present invention.

FIG. 1 is a block diagram illustrating an electrical arrangement of a DC stabilized power supply circuit 11 in accordance with the present embodiment. This DC stabilized power supply circuit 11 is generally arranged such that an output capacitor C is externally attached to a circuit chip 12 of a semiconductor, and a power transistor Q is connected in series with a power source line 13 provided between (i) an input terminal P1 connected to a DC power source so as to receive an input voltage Vin and (ii) an output terminal P2 connected to a DC load so as to output an output voltage Vo. The base current Id of the power transistor Q is controlled by a base drive circuit composed of a control transistor TR1, etc.

The output voltage Vo is divided by voltage dividing resistors R1 and R2 so that a divided voltage value Vadj is generated, and the divided voltage value Vadj and an external reference voltage Vref, the latter being produced with reference to a band gap voltage, are supplied to a difference amplifier A1. The voltages Vadj and Vref are compared with each other by the difference amplifier A1, and the difference between the voltages is amplified so as to be sent to the base of the control transistor TR1. Also, the control transistor TR1 controls the base current of the power transistor Q and hence the output voltage Vo is kept at a constant value. Between the base and emitter of the power transistor Q, a bypass transistor TR2 which is described later is provided, whereas to the emitter of the control transistor TR1, a current restraining resistor R3 is connected. The bypass transistor TR2 and the resistor R3 constitute the above-identified base drive circuit.

It should be noted that the DC stabilized power supply circuit 11 of the present embodiment is additionally provided with difference amplifiers A2 and A3 which use the divided voltage value Vadj of the output voltage Vo and the external reference voltage Vref generated with reference to the band gap voltage as in the above-identified difference amplifier A1. In the difference amplifier A1, provided that an internal reference voltage which is a standard of comparison is set as Vref1, the band gap voltages of the difference amplifiers A1 to A3 are arranged to be different from each other so that an internal reference voltage Vref2 of the difference amplifier A2 is arranged to be greater than the internal reference voltage Vref1 by a predetermined level Vos2, and an internal reference voltage Vref3 of the difference amplifier A3 is arranged to be smaller than the internal reference voltage Vref1 by a predetermined level Vos3.

Figure 2:
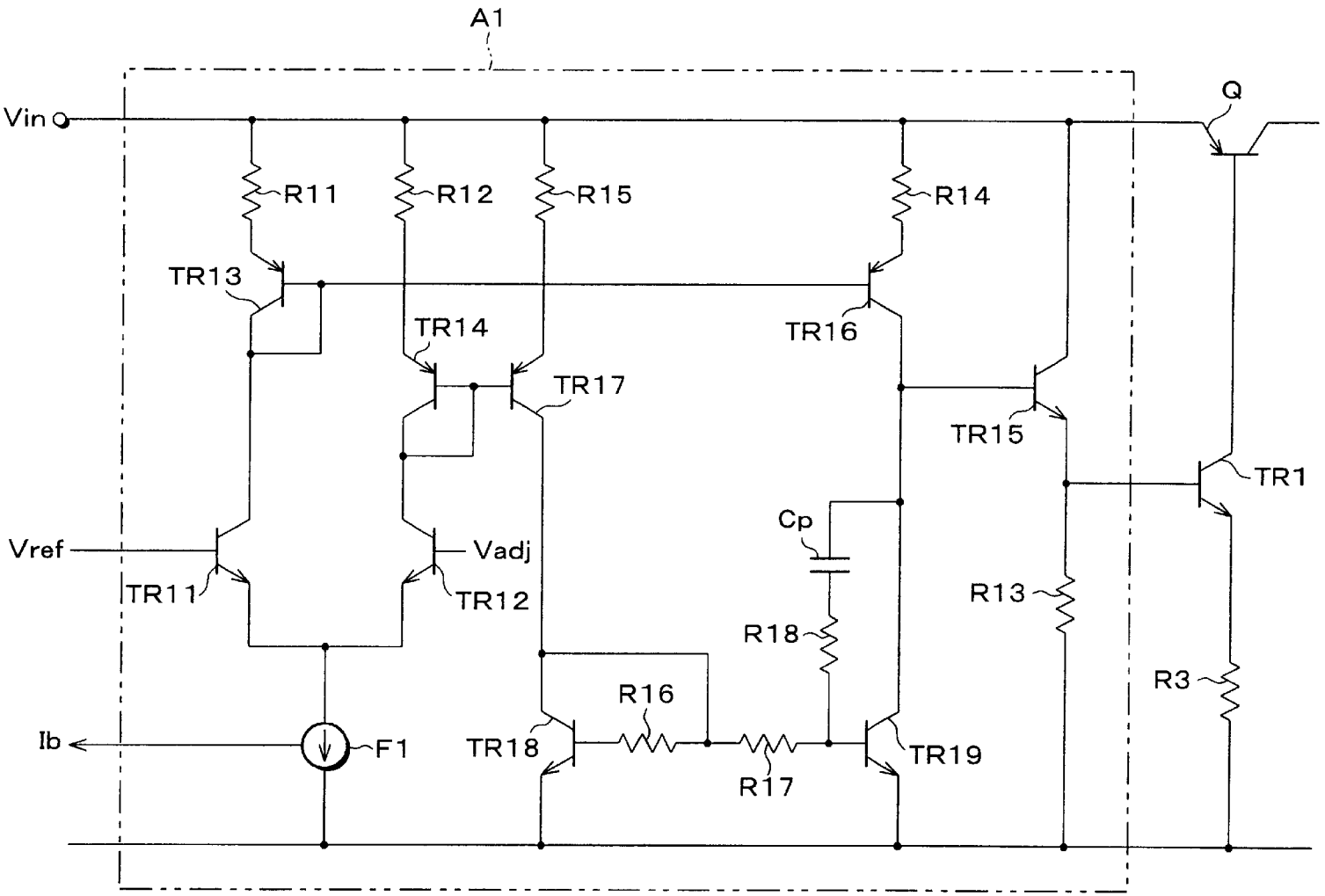
FIG. 2 is an electric circuit diagram illustrating a first difference amplifier of the DC stabilized power supply circuit in FIG. 1.

FIG. 2 is an electric circuit diagram of the difference amplifier A1. This difference amplifier A1 is constituted by: twinned transistors TR11 and TR12 which are arranged such that the external reference voltage Vref is supplied to the base of the transistor TR11 and the divided voltage value Vadj is supplied to the base of the transistor TR12; a constant current source F1 in which a constant current is flown via a junction connected to both of the emitters of the transistors TR11 and TR12; transistors TR13 and TR14 and resistors R11 and R12, the transistor TR13 and the resistor R11 supplying a collector current to the transistor TR11 while the transistor TR14 and the resistor R12 supplying a collector current to the transistor TR12; a transistor TR15 and a resistor R13 which output the base current of the control transistor TR1; a transistor TR16 and a resistor R14 which supply a current equal to the current which is supplied by the transistor TR13, to the base of the transistor TR15; transistors TR17 to TR19 and resistors R15 to R18 in which a current, which is equivalent to the current running through the transistor TR14, is supplied from the base of the transistor TR15; and a phase compensation capacity Cp.

According to this arrangement, the greater the external reference voltage Vref is than the divided voltage value Vadj, i.e. the smaller the output voltage Vo is than the predetermined output voltage Vc, the more the collector current of the transistor TR11 flows. A current equal to this collector current is supplied to the base of the transistor TR15 by a current mirror circuit constituted by the transistors TR13 and TR16, so that the emitter current of the transistor TR15 increases. Hereby a terminal voltage of the resistor R13, in other words the base voltage of the control transistor TR1 increases so that the base current Id of the power transistor Q increases, and consequently the output voltage Vo increases.

On the contrary, the greater the divided voltage value Vadj is than the external reference voltage Vref, i.e. the greater the output voltage Vo is than the predetermined output voltage Vc, the more the collector current of the transistor TR12 is. A current equal to this collector current is supplied to the base terminal of the transistor TR15 by a current mirror circuit constituted by the transistors TR14 and TR17 and a current mirror circuit constituted by the transistors TR18 and TR19, and on account of the supplied current, the base current of the transistor TR15 is bypassed. Hereby the emitter current of the transistor TR15 decreases, a terminal voltage of the resistor R13, in other words the base voltage of the control transistor TR1 decreases, the base current Id decreases, and consequently the output voltage Vo decreases.

Moreover, the constant current source F1 alters a constant current flown via the emitter of the transistors TR11 and TR12, in accordance with a bias current Ib from the difference amplifier A3. When the bias current Ib increases, the constant current source F1 increases the constant current, and hence the gain of the difference amplifier A1 is increased.

Figure 3:
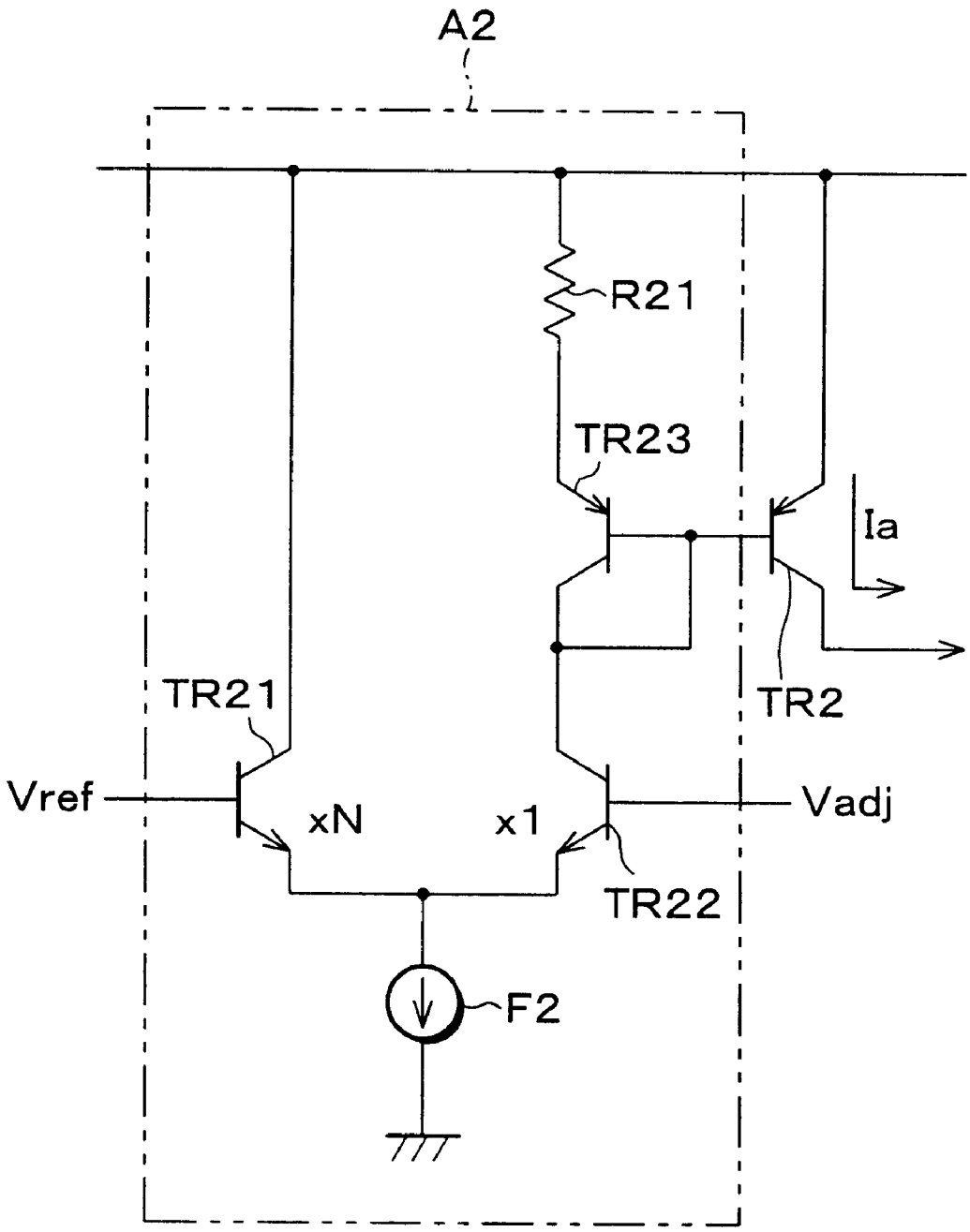
FIG. 3 is an electric circuit diagram illustrating a second difference amplifier of the DC stabilized power supply circuit in FIG. 1.

FIG. 3 is an electric circuit diagram of the difference amplifier A2. This difference amplifier A2 is constituted by: twinned transistors TR21 and TR22 which are arranged such that the external reference voltage Vref is supplied to the base of the transistor TR21 and the divided voltage value Vadj is supplied to the base of the transistor TR22; a constant current source F2 in which a constant current is flown via a junction connected to both of the emitters of the transistors TR21 and TR22; and a transistor TR23 and a resistor R21 which supply a collector current to the transistor TR22. The transistor TR23 and the bypass transistor TR2 constitute a current mirror circuit so that a current equal to the collector current of the transistor TR22 is output from the bypass transistor TR2. The current Ia, which is output from the bypass transistor TR2, is supplied to the control transistor TR1. Thus the more the current Ia flows, the more the base current Id of the power transistor Q is restrained.

Figure 4:
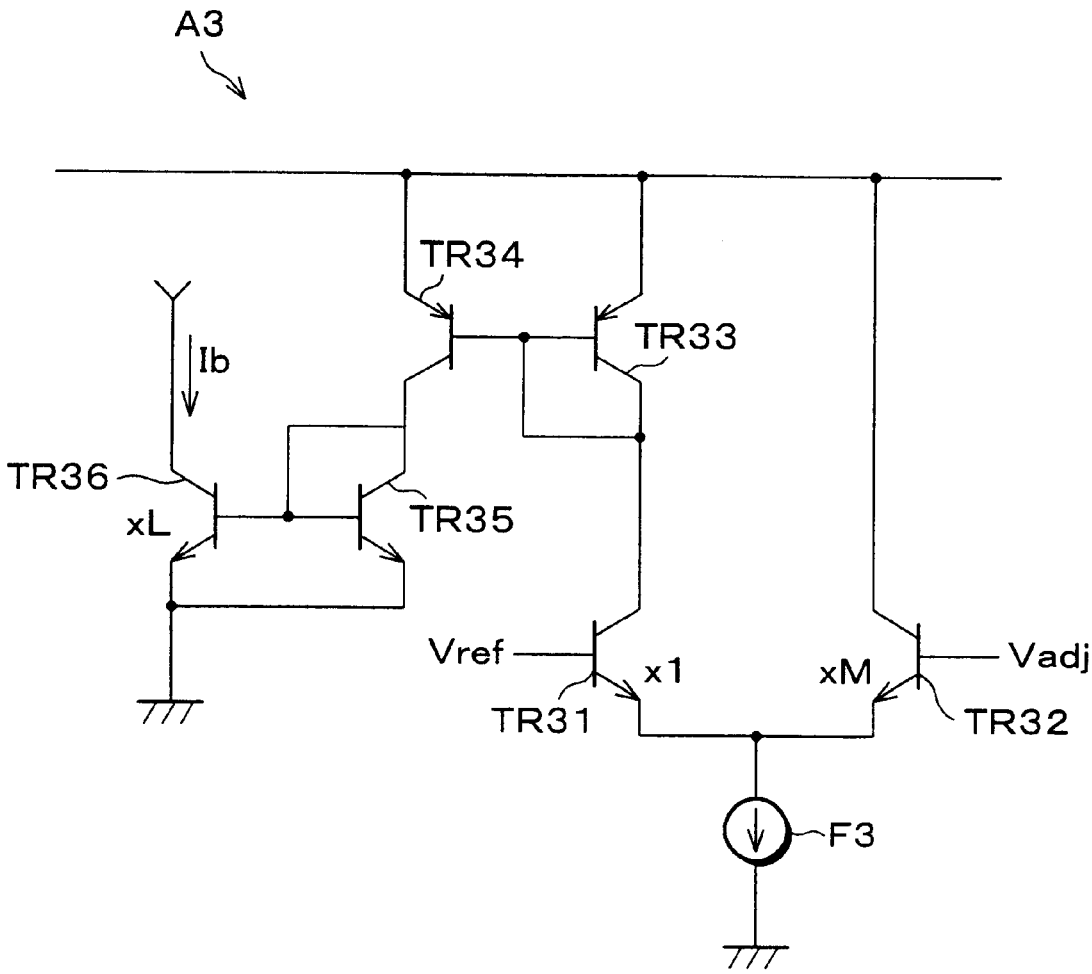
FIG. 4 is an electric circuit diagram illustrating a third difference amplifier of the DC stabilized power supply circuit in FIG. 1.

FIG. 4 is an electric circuit diagram of the difference amplifier A3. This difference amplifier A3 is constituted by: twinned transistors TR31 and TR32 which are arranged such that the external reference voltage Vref is supplied to the base of the transistor TR31 and the divided voltage value Vadj is supplied to the base of the transistor TR32; a constant current source F3 in which a constant current is flown via a junction connected to both of the emitters of the transistors TR31 and TR32; and a pair of transistors TR33 and TR34 and a pair of transistors TR35 and TR36 in which a collector current of the transistor TR31 is flown. The pair of the transistors TR33 and TR34 and the pair of the transistors TR35 and TR36 constitute current mirror circuits respectively. On account of these current mirror circuits, a current supplied from the difference amplifier A1 is arranged to be equivalent to the collector current running through the transistor TR31. The current supplied from the difference amplifier A1 is the bias current Ib of the difference amplifier A1.

In the DC stabilized power supply circuit 11 arranged as above, differential pairs corresponding to the difference amplifiers A1, A2, and A3 respectively are arranged as follows: an emitter area of the transistor TR11 and that of the transistor TR12 are identical; an emitter area ratio of the transistor TR21 to TR22 in the difference amplifier A2 is N:1; and an emitter ratio of the transistor TR31 to TR32 in the difference amplifier A3 is 1:M. On account of the band gap voltages generated in accordance with the ratios above, while an input offset voltage of the difference amplifier A1 is 0V, offset voltages of the difference amplifiers A2 and A3 are Vos2 and −Vos3 respectively. These difference amplifiers A2 and A3 carry out so-called window comparator operation.

Therefore, when the above-identified emitter area ratios are N=M=4, the input offset voltages Vos2 and Vos3 are $VT^{*}1n4 \approx 36$ mV so that even if the external reference voltage Vref is applied to the difference amplifiers A1, A2, and A3, the internal reference voltage Vref2 of the difference amplifier A2 is greater than the internal reference voltage Vref1 of the difference amplifier A1 by a value of the input offset voltage Vos2 (in this case 36 mV), and the internal reference voltage Vref3 of the difference amplifier A3 is smaller than the internal reference voltage Vref1 by a value of the input offset voltage Vos3 (in this case 36 mV). Meanwhile, when N=M=3, Vos2=Vos3≈28 mV. The input and output characteristics of each of the difference amplifiers A1 to A3 in this case are illustrated in FIG. 5.

Figure 5:
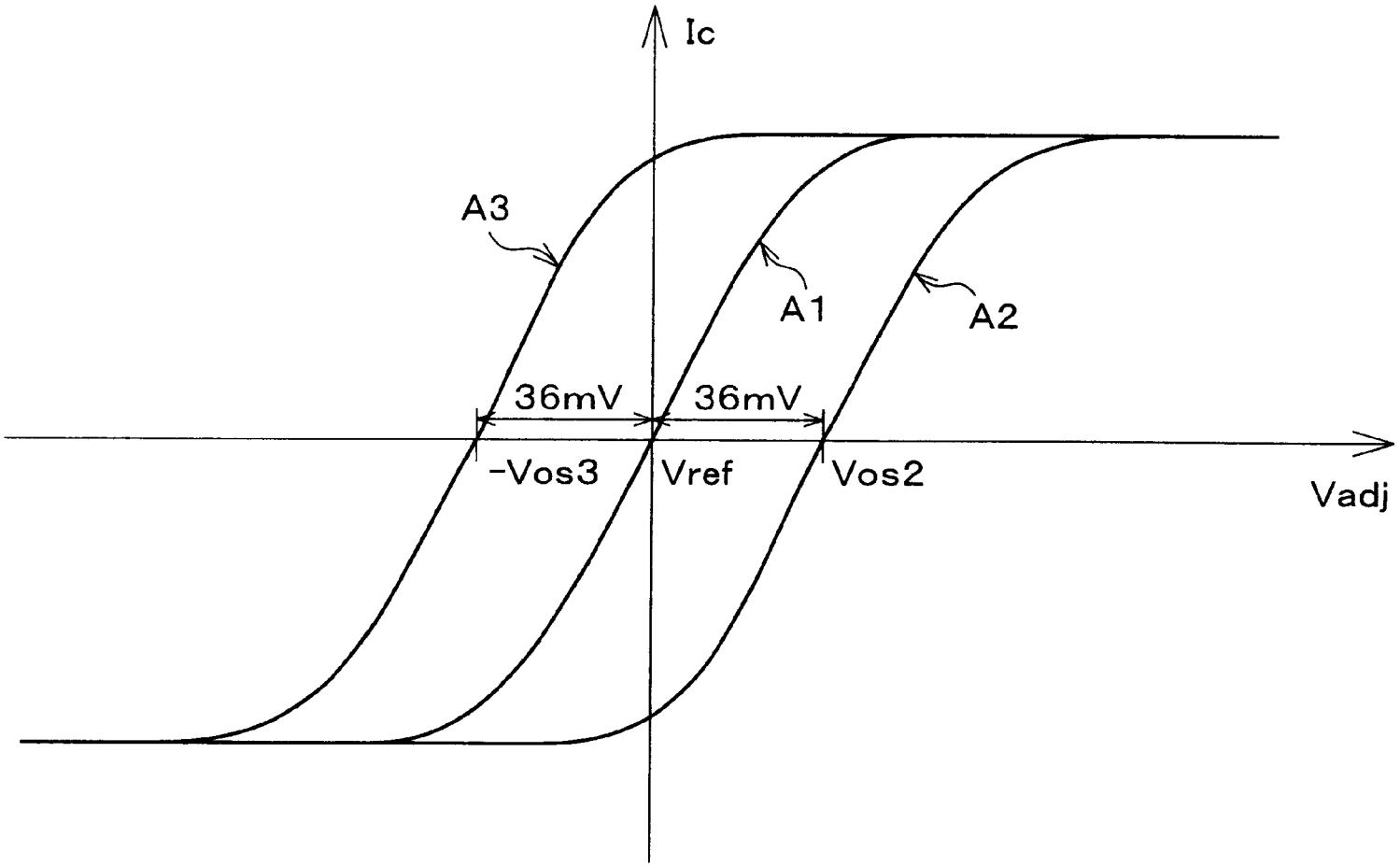
FIG. 5 is a graph indicating input and output characteristics of each of the above-identified difference amplifiers.
Figure 6:
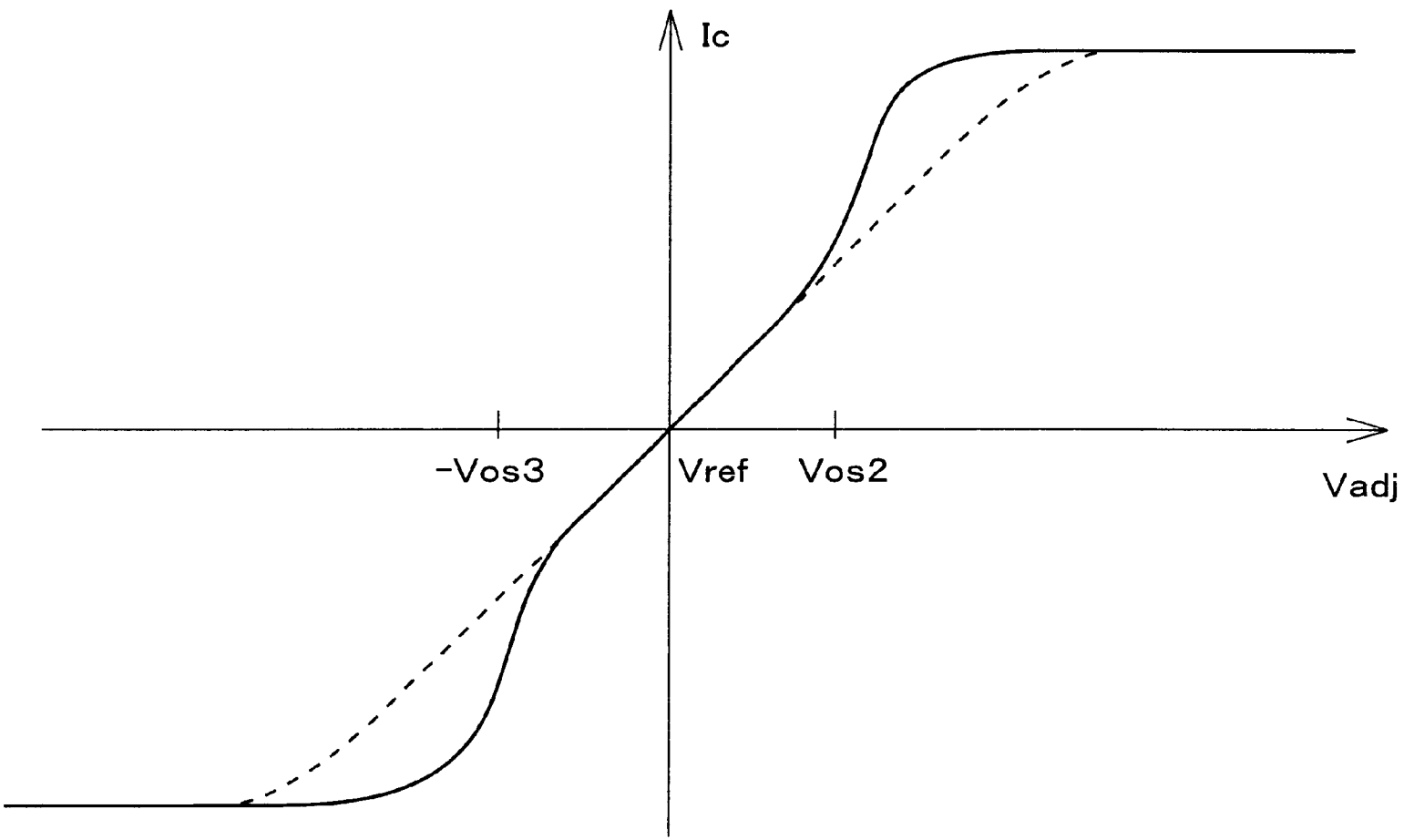
FIG. 6 is a graph indicating input and output characteristics of the DC stabilized power supply circuit, with which the input and output characteristics of each of the difference amplifiers in FIG. 5 are incorporated.

As FIG. 5 clarifies, when the divided voltage value Vadj is approximate to the external reference voltage Vref, an output current Ic of the difference amplifier A1 significantly varies in accordance with the variation of the divided voltage Vadj, in other words, the difference amplifier A1 operates with high gain. When the divided voltage reference is approximate to a value Vref+Vos2, the difference amplifier A2 operates with high gain, and when the divided voltage value Vadj is around a value Vref-Vos3, the difference amplifier A3 operates with high gain.

Thus, when the output voltage Vo is approximate to the predetermined output voltage Vc, the base current Id of the power transistor Q is stabilized by the output of the difference amplifier A1. On the contrary, when the load is lessened, i.e. when the load current decreases so that the output voltage Vo becomes greater than the predetermined output voltage Vc by a predetermined value corresponding to the input offset voltage Vos2 or more, the base current Id is restrained by the difference amplifier A1, and since the difference amplifier A2 operates in parallel with the difference amplifier A1, the base current Id is further restrained on account of a bypass current Ia supplied from the difference amplifier A2. Consequently the power transistor Q is promptly turned off so that it is possible to decrease the output voltage Vo. On the contrary, when the load current increases so that the output voltage Vo becomes smaller than the predetermined output voltage Vc by a predetermined value corresponding to the output offset voltage Vos3 or more, the difference amplifier A1 increases the base current Id, and since the difference amplifier A3 operates in parallel with the difference amplifier A1, a bias current Ib supplied from the difference amplifier A3 increases so that the gain of the difference amplifier A1 increases, and thus the base current Id further increases. Consequently the power transistor Q is promptly turned on so that it is possible to increase the output voltage Vo. Synthesizing the input and output characteristics of these difference amplifiers A1 to A3, the DC stabilized power supply circuit 11 operates with the input and output characteristics illustrated in FIG. 6.

The arrangement above makes it possible to further stabilize the output voltage Vo by setting the feedback phase compensation capacity Cp large. In the meantime, in response to drastic variation of the load current, it is possible to prevent considerable variation of the output voltage Vo which is caused due to delayed response from a feedback system of the difference amplifier A1, by additionally providing the difference amplifiers A2 and A3, so that the capacity of the output capacitor C can be reduced. Moreover, in the difference amplifiers A2 and A3, the emitter areas of the differential pairs thereof are not identical with the emitter area of the differential pair of the difference amplifier A1 so that the band gap voltages are generated, and using these voltages, the internal reference voltages of the difference amplifiers A2 and A3 are set as the external reference voltage Vref plus the input offset voltage Vos2 and the external reference voltage Vref minus the input offset voltage Vos3 respectively, and hence the difference amplifiers A2 and A3 can be simply arranged yet operate with a high degree of accuracy.

Figure 7:
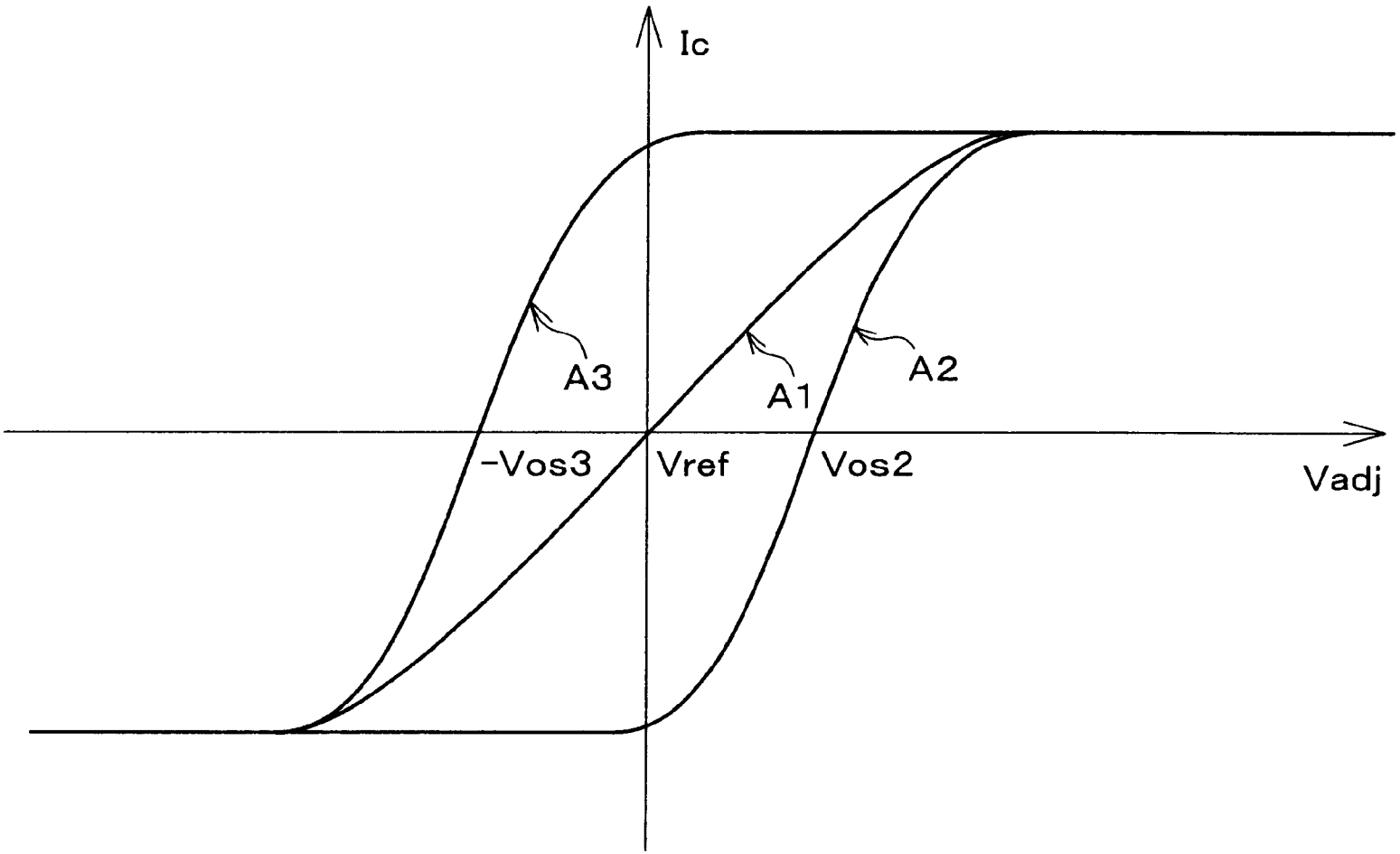
FIG. 7 is a graph indicating input and output characteristics of each of the difference amplifiers when the gain of the first difference amplifier of FIG. 1 is arranged so as to be low.
Figure 8:
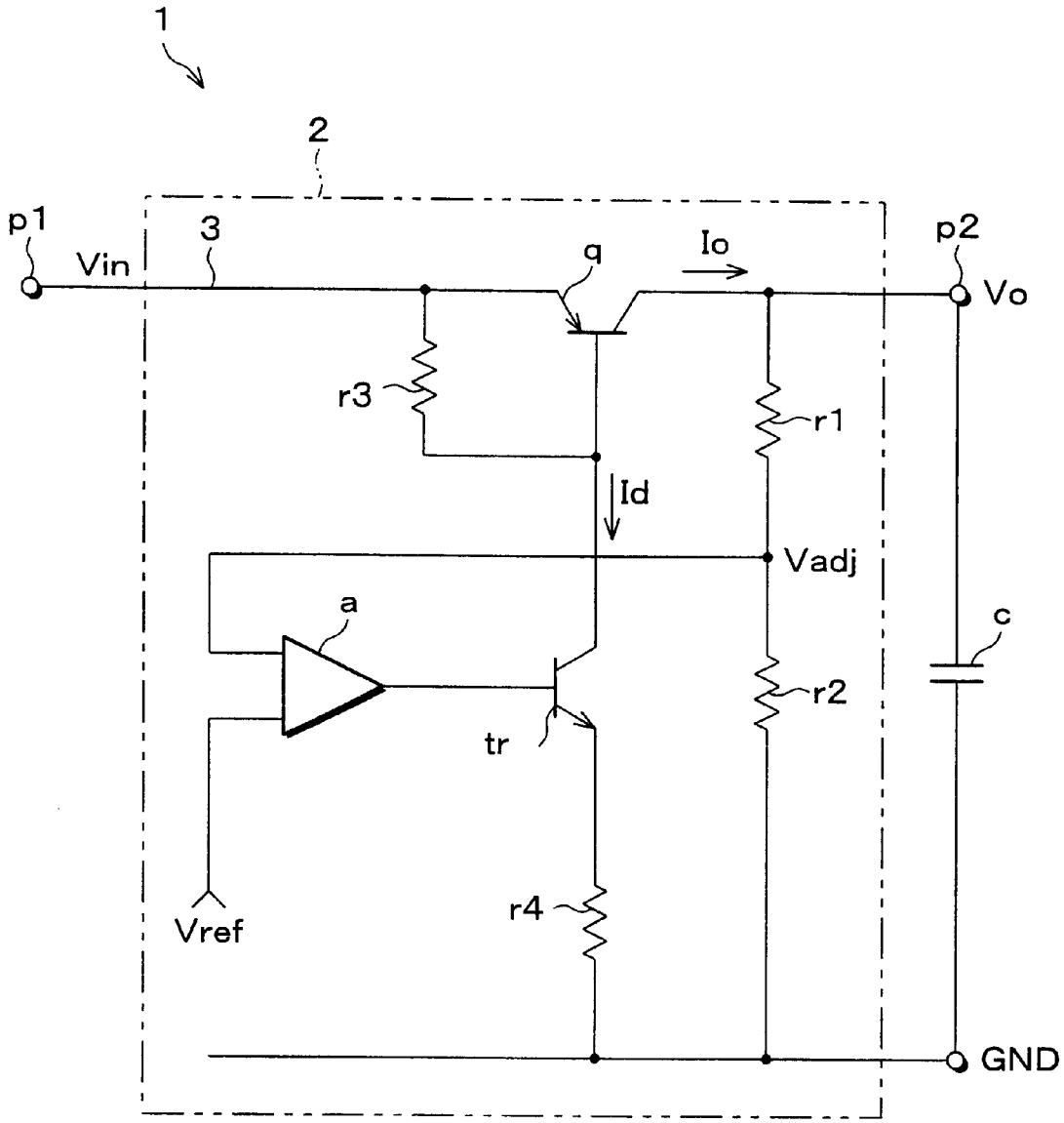
FIG. 8 is a block diagram illustrating an electrical arrangement of a typical dropper-type DC stabilized power supply circuit of conventional art.
Figure 9:
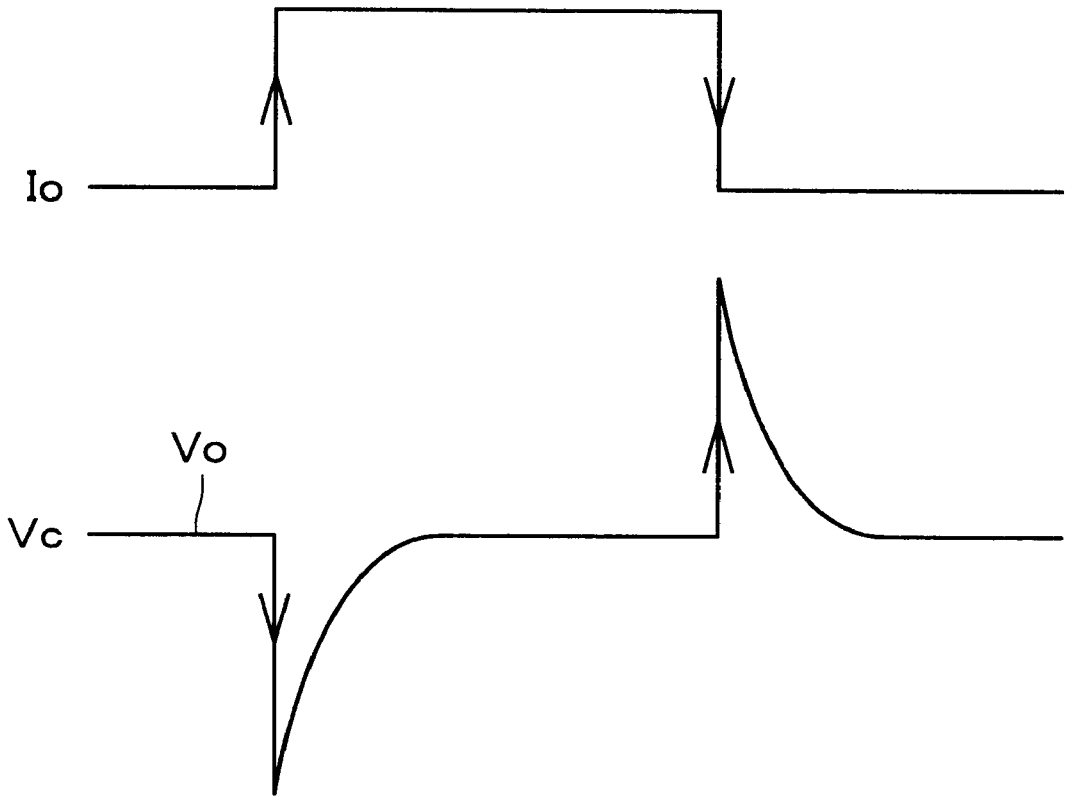
FIG. 9 is an waveform chart illustrating the variations of a base current of the power transistor according to the variations of an output voltage with respect to a predetermined output voltage.
Figure 10:
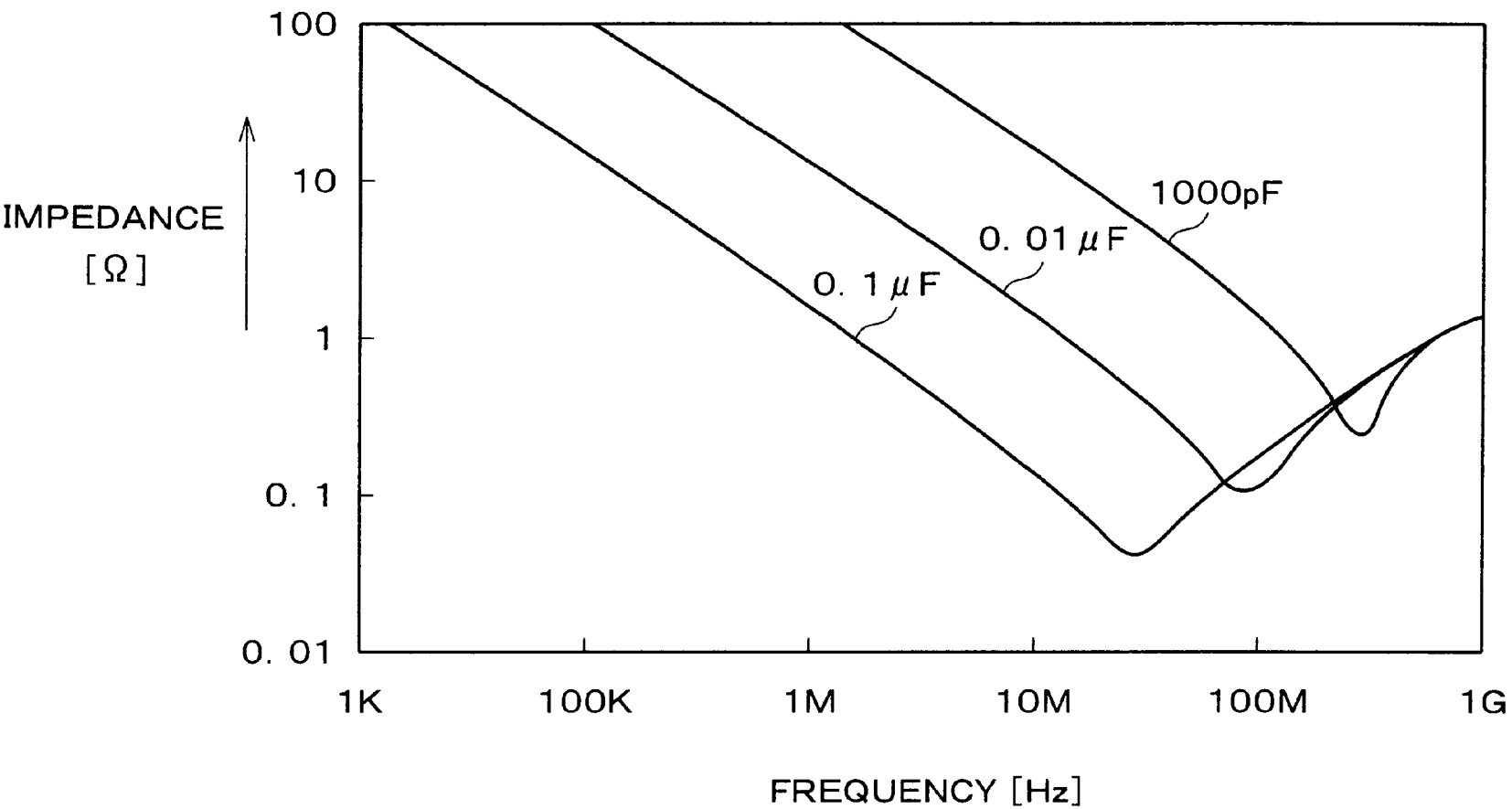
FIG. 10 is a graph indicating frequency characteristics of an output capacitor.
Figure 11:
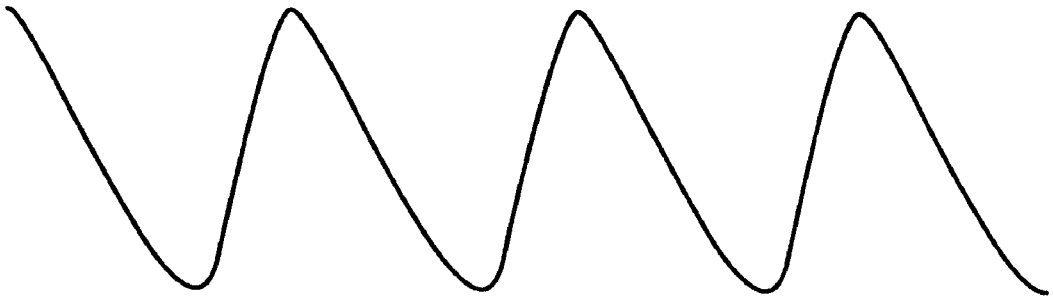
FIG. 11 is an waveform chart illustrating conventional variations of the output voltage at the time of the load fluctuation.

Since additionally providing the difference amplifiers A2 and A3 enables the DC stabilized power supply circuit to keep up with the drastic variation of the load current as described above, it is possible to change the gain of the difference amplifier A1 from normal as illustrated in FIG. 5 to low as illustrated in FIG. 7, so as to further lessen the capacity of the output capacitor C.

Now, there are circuits in which the difference amplifier controls the bypass current Ia in accordance with the difference between the external reference voltage Vref and the divided voltage value Vadj so as to restrain the base current Id of the power transistor Q, such as a short-circuit proof circuit. However, in a overcurrent protection mode in which the base current Id is controlled in accordance with the voltage between the terminals of the resistor R3, the short-circuit proof circuit operates contrary to the operation of the difference amplifier A2, in other words, the short-circuit proof circuit operates contrary to the operation in which the difference amplifier increases the bypass current Ia when the divided voltage value Vadj is smaller than the external reference voltage Vref.

Moreover, for instance, Japanese Publication for Laid-Open Patent Application No. 5-289761/1993 (Tokukaihei 5-289761; Published on Nov. 5, 1993) discloses an arrangement in which on-resistance of a power transistor increases when the output voltage increases, and in accordance with the degree of the increase of the on-resistance above, on-resistance of a transistor which short-circuits the load decreases and a reactive current is sent to restrain the increase of the output voltage, so that the responsiveness with respect to the variation of the load is improved and the capacity of an output capacitor is lessened. In the meantime, the present invention is arranged such that off-control of the power transistor Q is quickened and hence the increase of the output voltage itself is restrained. Therefore, the present invention exhibits smaller loss than the conventional art.

Furthermore, Japanese Publication for Laid-Open Patent Application No. 2000-245148 (Tokukai 2000-245148; Published on Sep. 8, 2000) discloses an arrangement for improving the responsiveness by detecting drastic variation of the load current. In the meantime, the present invention is arranged such that the gain of the difference amplifier A1 is changed in accordance with the decrease of the output voltage Vo, so that the present invention can be applicable to cases such as the variation of the load current is mild and a DC is adopted.

As described above, a DC stabilized power supply circuit (11) includes: a power transistor (Q) connected in series with a power supply line (13); a first difference amplifier (A1) in which an output voltage is stabilized by controlling a base current of said power transistor according to a difference between a feedback value of said output voltage and a predetermined first reference voltage so that said feedback value and said first reference voltage are equal to each other; a second difference amplifier (A2) in which a second reference voltage greater than said first reference voltage by a predetermined level is set, and the greater said feedback value of the output voltage is than said second reference voltage, the more said base current of the power transistor is restrained; and a third difference amplifier (A3) in which a third reference voltage smaller than said first reference voltage by a predetermined level is set, and the smaller said feedback value of the output voltage is than said third reference voltage, the more a gain of said first difference amplifier is increased.

According to this arrangement, the dropper-type DC stabilized power supply circuit is arranged so that the power transistor is connected in series with the power supply line connecting the DC power source with the DC load, the first difference amplifier compares (i) the feedback value which is acquired by dividing the output voltage using a voltage dividing resistor with (ii) a predetermined first reference voltage, the first difference amplifier controls the base current of the power transistor with reference to the difference acquired by the comparison above so as to control the on-resistance of the power transistor, and consequently the output voltage is stabilized. This DC stabilized power supply circuit is additionally provided with the second and third difference amplifiers which operate in parallel with the first difference amplifier. The second and third difference amplifiers are arranged so as to have respective reference voltages which are set as greater and smaller than the first reference voltage by a predetermined level, by adopting each different divided voltage values to each of the difference amplifiers or providing offsets for two of the three difference amplifiers. On this account, it is possible to shorten the period during which the power transistor is turned on/off, compared to a case when only the first difference amplifier is provided for the control.

That is to say, when the feedback value of the output voltage is greater than the second reference voltage, the second difference amplifier restrains the base current of the power transistor so as to shorten the period during which the power transistor is turned off, compared to the case of the first difference amplifier, and consequently the output voltage promptly decreases. On the contrary, when the output voltage is smaller than the third reference voltage, the third difference amplifier increases the gain of the first difference amplifier so as to shorten the period during which the power transistor is turned on, and consequently the output promptly increases.

Thus, it is possible to further stabilize the output voltage and reduce the capacity of the output capacitor (C).

Furthermore, the DC stabilized power supply circuit is arranged so that the second and third difference amplifiers respectively generate the second reference voltage which is greater than the first reference voltage by the predetermined level and the third reference voltage which is smaller than the first reference voltage by the predetermined level respectively, using band gap voltages due to differences (i) between an emitter area ratio of a differential pair of the first difference amplifier and an emitter area ratio of a differential pair of the second difference amplifier and (ii) between the emitter area ratio of the differential pair of the first difference amplifier and an emitter area ratio of a differential pair of the third difference amplifier, respectively.

According to this arrangement, even if the external reference voltage is commonly applied to the second and third difference amplifiers as well as the first difference amplifier, it is possible to set the reference voltages of second and third difference amplifiers to be different from that of the first difference amplifier, by simply using input offset voltages generated due to the variation of the emitter areas of the transistors of the differential pairs of the second and third difference amplifiers.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A DC stabilized power supply circuit, comprising:

a power transistor connected in series with a power supply line;

a first difference amplifier in which an output voltage is stabilized by controlling a base current of said power transistor according to a difference between a feedback value of said output voltage and a predetermined first internal reference voltage so that said feedback value and said first internal reference voltage are equal to each other;

a second difference amplifier in which a second internal reference voltage greater than said first internal reference voltage by a predetermined level is set, and the greater said feedback value of the output voltage is than said second internal reference voltage, the more said base current of the power transistor is restrained; and a third difference amplifier in which a third internal reference voltage smaller than said first internal reference voltage by a predetermined level is set, and the smaller said feedback value of the output voltage is than said third internal reference voltage, the more a gain of said first difference amplifier is increased.

2. The DC stabilized power supply circuit as defined in claim 1, wherein said second and third difference amplifiers respectively generate said second internal reference voltage which is greater than said first internal reference voltage by the predetermined level and said third internal reference voltage which is smaller than said first internal reference voltage by the predetermined level respectively, using band gap voltages due to differences (i) between an emitter area ratio of a differential pair of said first difference amplifier and an emitter area ratio of a differential pair of said second difference amplifier and (ii) between said emitter area ratio of said differential pair of said first difference amplifier and an emitter area ratio of a differential pair of said third difference amplifier, respectively.

3. The DC stabilized power supply circuit as defined in claim 1, wherein:

said first difference amplifier detects said difference between said feedback value and said first internal reference voltage, according to said feedback value supplied to the first difference amplifier and the external reference voltage supplied to the first difference amplifier;

said second difference amplifier includes a differential pair composed of two transistors each having different emitter area, wherein a base of one of said two transistors receives said feedback value of the output voltage and a base of the other of said transistors receives said external reference voltage;

said third difference amplifier includes a differential pair composed of two transistors each having different emitter area, wherein a base of one of said transistors receives said feedback value of the output voltage and a base of the other of said transistors receives said external reference voltage; and said emitter area of each of said transistors is arranged, in accordance with a band gap voltage of each of said differential pairs so as to make (i) said second internal reference voltage greater than said first internal reference voltage by said predetermined level and (ii) said third internal reference voltage smaller than said first internal reference voltage by said predetermined level.

4. The DC stabilized power supply circuit as defined in claim 1, further comprising a bypass transistor provided between a base and an emitter of said power transistor, wherein said second difference amplifier causes said bypass transistor to supply a current to a path of said base current so as to restrain said base current of the power transistor.

5. The DC stabilized power supply circuit as defined in claim 1, wherein said third difference amplifier increases a constant current flown through the differential pair of said first difference amplifier so as to increase a gain of said first difference amplifier.

6. The DC stabilized power supply circuit as define in claim 1, wherein the first internal reference voltage corresponds to the external reference voltage, the second internal reference voltage is set as the external reference voltage plus the offset voltage of the second difference amplifier, and the third internal reference voltage is set as the external reference voltage minus the offset voltage of the third difference amplifier.

7. The DC stabilized power supply circuit as defined in claim 1, wherein the first, second, and third internal reference voltages are set based on a relationship between an external reference voltage and offset voltages generated due to variations of emitter areas in the first, second, and third difference amplifiers, respectively.

* * * * *